United States Patent [19]

Fritzinger

[11] 4,455,775

[45] Jun. 26, 1984

[54] VANDALPROOF STREET NAME SIGN

[76] Inventor: George H. Fritzinger, 15 Standish Ave., West Orange, N.J. 07052

[21] Appl. No.: 424,863

[22] Filed: Sep. 28, 1982

[51] Int. Cl.[3] ..... G09F 15/00

[52] U.S. Cl. ..... 40/607

[58] Field of Search ..... 40/607, 584, 606, 10 R

[56] References Cited

U.S. PATENT DOCUMENTS

| | | | |
|---|---|---|---|
| 965,566 | 7/1910 | Cooley | 40/607 |
| 1,826,581 | 10/1931 | Sprung | 40/607 |
| 3,218,746 | 11/1965 | Hawkins | 40/16 X |

*Primary Examiner*—Gene Mancene

*Assistant Examiner*—Wenceslao J. Contreras

[57] ABSTRACT

A street name sign of a vandalproof type which comprises one or more sign heads of a hollow aluminum-frame construction and a center staff passing centrally through the sign heads and down into the post supporting the sign, is provided with a lock collar clamped to the lower end of the center staff and itself having a one-way locking action against the inside wall of the post permitting the sign to be readily pressed down onto the post but locking the sign against any unauthorized removal. The lock collar is secured firmly to the center staff preferably by clamping pressure exerted through the sign assembly to hold the whole assembly on the center staff in an integral construction.

8 Claims, 4 Drawing Figures

VANDALPROOF STREET NAME SIGN

This application is an improvement on my U.S. Pat. No. 3,935,655 dated Feb. 3, 1976 wherein there is disclosed a bottom collar secured to the center staff by two cantilever springs and pins driven through the wall of the post above the collar to prevent removal of the sign from the post. This construction provided an important deterrent against vandalism but was inadequate because the pins were visible and could be easily driven out and because the cantilever springs did not secure the collar firmly to the center staff against undergoing tilting with resultant bending of the springs as the sign structure was lifted forcibly against the pins.

An object of the invention is to provide a sign structure wherein a removable element in the mounting post constitutes the sole means for disassembling the sign, and this removable element is rendered inaccessible when the sign is mounted by a locking means acting against the inside wall of the post to prevent any removal of the sign.

Another object is to clamp a collar firmly to the lower end portion of the center staff and to provide a locking means on the collar acting against the inside wall of the post which is not visible or accessible to the outside.

Another object is to provide a locking means comprising a pair of cantilever springs which project normally beyond the periphery of the collar so that they are bent upwardly against inside wall of the post to permit easy installment of the sign down onto the post but which engage the wall at a critical angle to lock the sign against unauthorized removal from the post.

A further object is to clamp the lock collar to the center staff in a firm manner, preferably by clamping pressure exerted through the sign assembly to hold the assembly into an integral construction with the center staff.

These and other objects and features of the invention will be apparent from the following description and the appended claims.

In the description of my invention reference is had to the accompanying drawings, of which:

Figure 1:
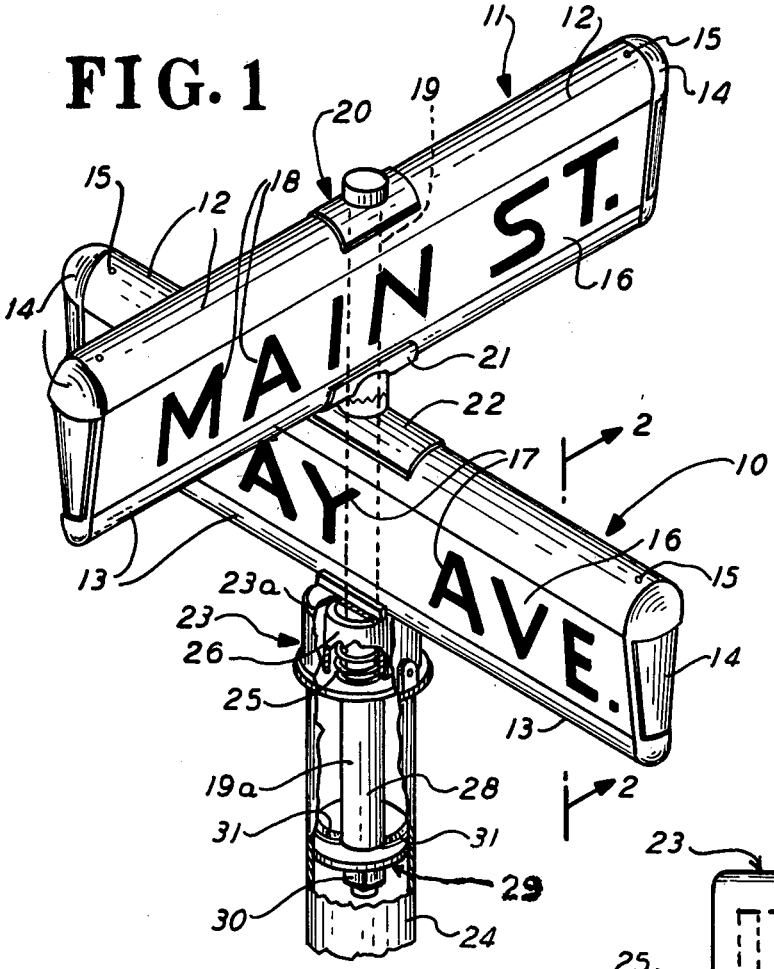
FIG. 1 is a perspective view of a 4-way (two sign head) type of street name sign incorporating the invention, wherein parts are broken away to show better the details thereof.
Figure 2:
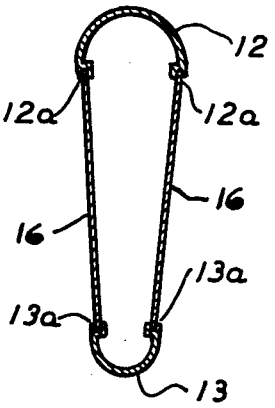
FIG. 2 is a cross-sectional view taken on the line 2—2 of FIG. 1.

The street name sign shown in the accompanying drawings may include a single sign head 10 or two such heads 10 and 11 to constitute a 4-way sign as shown in FIG. 1. Each sign head includes a hollow frame structure comprising a top extrusion 12 and a bottom extrusion 13 each of a semi-circular cross-section shown in FIG. 2. The extrusions are joined at the end by end caps 14 secured by stainless steel POP rivets 15 to form a rigid rectangular frame. Locked into the frame are two name panels 16 fitting along their top and bottom edges into grooves **12*a* and 13*a*** of the extrusions and retained at the ends by the end caps. The name panels are faced with reflective sheeting and are printed with letters and numbers designating street names.

The top and bottom extrusions are apertured midway their lengths to receive a center staff 19 preferable of hot rolled steel for maximum strength. Threaded to the upper end of center staff is a top cap 20 having a wing formation fitting onto and interlocking with the top extrusion 12. The center staff passes through the sign heads and through a criss-cross set 21–22 between the sign heads having interengaging teeth to permit the sigh heads to be set at different angles to each other. Below the sign heads the center staff passes through a post cap 23 having a trough **23*a* to receive the lower extrusion 13 and a depending cylindrical portion 23*b* to fit over the upper part of a post 24. The center staff has a low portion 19*a*** extending past the post cap and down into the post. Secured to the lower end of the center staff is a locking means of new design adapted to achieve an effective vandalproof protection against the sign being removed and stolen from the post, as is herein next described.

The structure on the center staff below the post cap comprises in the order here named a compression spring 25 pressed against the upper inside wall of the post cap, a spring-limit sleeve 26 surrounding the compression spring, a plain collar 27 below the compression spring 25 and sleeve 26, a spacer tube 28 below the collar 27, a bottom lock collar 29 below the spacer tube and a jam nut 30 threaded on the end of the center staff against the lock collar.

Figure 3:
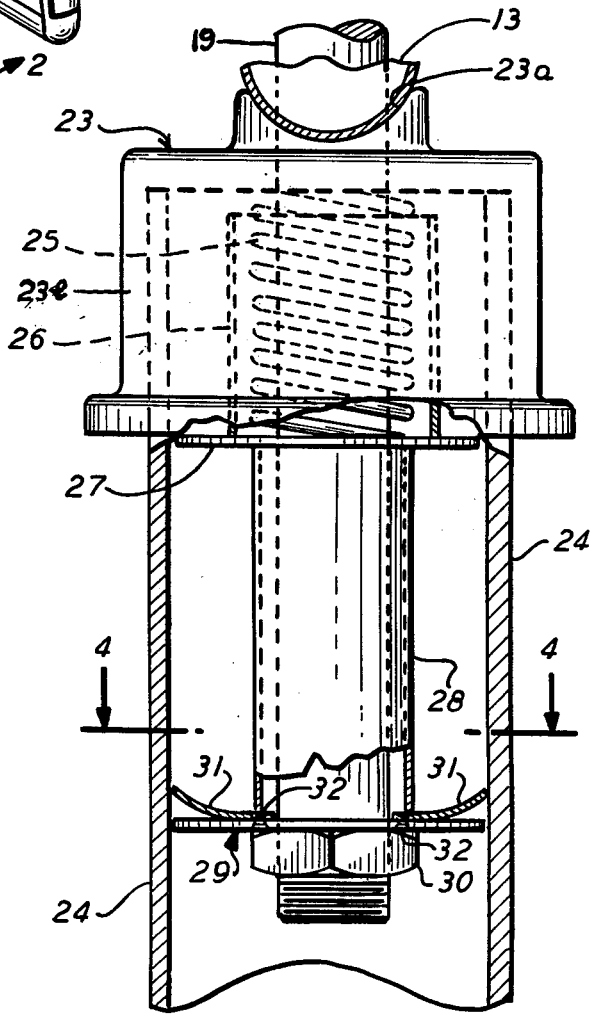
FIG. 3 is an elevational view to larger scale of the lower locking structure of the sign, showing the post and other parts broken away to illustrate better the action of the locking means.
Figure 4:
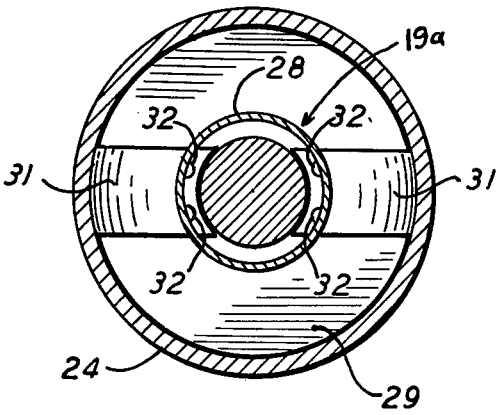
FIG. 4 is a sectional view taken on the line 4—4 of FIG. 3.

After threading the top cap 20 tightly onto the center staff 19 and then assembling the sign components on the center staff in the order above described, the jam nut 30 is tightened until the top collar 27 is about flush with the bottom rim of the post cap 23, as shown in FIG. 3. At this degree of tightening the compression spring 25 can be further compressed within a limit of the height of the interengaging teeth of the criss-cross set 21–22 determined by the spring limit sleeve 26, to allow a forcible shifting of the sign heads relative to each other without exertion of such force as might bend or break any of the sign components. However, the spring limit sleeve 26 is designed not to permit a compression of the spring through the greater height of the trough **23*a*** in the post cap. This is done so as not to allow the bottom sign head to be lifted and turned crosswise to the trough, a condition which would provide a fulcrum point adjacent to the center staff, making it more vulnerable to a bending stress exerted by a yanking of one's weight from the ends of the sign heads.

The lock collar 29 has a clearance fit in the post 24 of about 1/32" play, and has two diametrically opposite flat cantilever springs 31 of stainless steel secured by stainless steel rivets 32 to the top side of the collar 29 near the center hole thereof. The springs extend about 1/16" beyond the periphery of the collar so that as the sign structure is pressed down onto the post the springs are bowed upwardly allowing the sign to be easily mounted. However, by this bowing the springs engage the inside wall of the post at a critical angle causing them to lock against the inside wall to prevent the sign structure from being lifted and stolen from the post.

As above described, the whole sign structure is held firmly by the jam nut 30 to the center staff by clamping pressure exerted through the sign structure against the top cap. Since the top cap is locked to the top extrusion, the sign structure can be disassembled only by removing the jam nut but so long as the sign is mounted on the post, the jam nut is hidden from view and is inaccessible. The use of a lock collar 29 as above described assures against an unauthorized removal of the sign from the post up to any selected withdrawal force. For example, when the collar is made of cold rolled steel of 0.065 thickness, and the cantilever springs are made of stainless steel of 0.020 thickness and ½" width, the collar will withhold removal of the sign from the post up to 300# lifting force. It is found this required force effectively safeguards the signs from vandalism but still allows a forced removal, with a bending of the locking collar, by authorized personnel for purposes of replacement or repair.

These and other objects and features of the invention will be apparent from the foregoing description and the appended claims.

I claim:

1. In a street name sign comprising a hollow-frame sign head, a top cap in interlocking engagement with said sign head, a post cap adapted for mounting on the upper end of a cylindrical sign post, and a center staff extending centrally through said sign head and said post cap with the upper end threaded into said top cap and the lower end portion extending beyond said post cap: the combination of a removable element secured to said lower end portion of said center staff constituting the sole removable element for disassembling the sign, and a one-way locking means secured to said lower end portion of said center staff and having a sliding one-way locking engagement with the inside wall of the post as the sign is pressed down onto the post for locking the sign against removal therefrom whereby to safeguard the sign against being disassembled and/or stolen from the post.

2. The claim set forth in claim 1 wherein said post cap has a trough receiving the bottom of said sign head and said removable element constitutes a nut threaded on said center staff, including a means interposed between said nut and said post cap for holding the overhead components of the sign clamped under pressure against said top cap, said means including a compression spring surrounding said center staff and a limit sleeve surrounding said compression spring to prevent a compressing of said spring sufficient to allow said sign head to be lifted out of said trough and turned crosswise thereto.

3. The claim set forth in claim 2 wherein said street name sign includes a second sign head and a criss-cross set with inter-engaging teeth of a height less than the height of said trough to permit the heads to be set at a selected angle to each other, and said limit sleeve is adapted to allow a compressing of said spring through the height of said teeth to permit a forcible shifting of the sign heads relative to each other.

4. The claim set forth in claim 1 wherein said locking means comprises a collar firmly secured to said center staff and having a clearance fit in said post, and a pair of flat diametrically -opposite cantilever springs secured to the top side of said collar and extending radially beyond the periphery thereof when in a free state whereby the springs are bowed upwardly in sliding engagement with the inside wall of said post as the sign is pressed down into mounted position but are locked against said inside wall when a lifting force is exerted on the sign whereby to prevent a removal of the sign from the post.

5. The claim set forth in claim 4 wherein said collar is clamped to said center staff by a nut threaded thereon against the collar.

6. The claim set forth in claim 5 including means on said center staff interposed between said locking collar and said post cap for applying clamping pressure from said nut through the overhead components on the center staff above the post cap against said top cap to hold the entire sign structure in a unitary assembly.

7. The claim set forth in claim 6 wherein said interposed means comprises a compression spring for allowing an adjustable clamping pressure to be achieved by the degree of tightening of said nut.

8. In a street name sign comprising a hollow-frame sign head, a top cap in interlocking engagement with said sign head, a post cap adapted for mounting on the upper end of a cylindrical sign post, and a center staff extending centrally through said sign head and said post cap with the upper end threaded into said top cap and the lower end portion extending beyond said post cap: the combination of means on said center staff securing said post cap and sign head into a unitary structure with clamping pressure against said top cap, and a lock collar secured firmly to the lower end of said center staff beyond said post cap, said collar having a clearance fit in said post as the sign is mounted thereon, and a pair of diametrically- opposite cantilever springs secured to the upper side of said collar adjacent to said center staff and having outer end portions extending beyond the periphery of said collar whereby when the sign is pressed down onto said post, said springs are bowed upwardly with a sliding one-way locking action against the inside wall of the post to permit easy mounting of the sign onto the post but to prevent a removal of the sign from the post.

* * * * *